US007787804B2

(12) United States Patent
Yamamoto

(10) Patent No.: US 7,787,804 B2
(45) Date of Patent: Aug. 31, 2010

(54) CHARGING MEMBER, CHARGER APPARATUS WITH CHARGING MEMBER, AND IMAGE FORMING APPARATUS HAVING CHARGER APPARATUS

(75) Inventor: Masanori Yamamoto, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 36 days.

(21) Appl. No.: 11/783,229

(22) Filed: Apr. 6, 2007

(65) Prior Publication Data

US 2007/0237548 A1 Oct. 11, 2007

(30) Foreign Application Priority Data

Apr. 7, 2006 (JP) ..... 2006-106020

(51) Int. Cl.
*G03G 15/02* (2006.01)

(52) U.S. Cl. ..... 399/174; 399/176; 361/221

(58) Field of Classification Search ..... 399/174, 399/176; 361/212, 221, 223, 225
See application file for complete search history.

(56) References Cited

U.S. PATENT DOCUMENTS 5,390,007 A 2/1995 Kugoh et al.
5,786,091 A * 7/1998 Kurokawa et al. ..... 428/421
6,319,181 B1 * 11/2001 Naoi et al. ..... 492/56
6,454,688 B1 * 9/2002 Okuda et al. ..... 492/56

FOREIGN PATENT DOCUMENTS

JP 05-210281 A 8/1993
JP 05-224506 9/1993
JP 2000-275930 10/2000
JP 2003-215951 7/2003

OTHER PUBLICATIONS

English Language Translation of First Office Action in Japanese Patent Application No. 2006-106020 dated Apr. 8, 2008.
English Language Translation of Second Office Action in Japanese Patent Application No. 2006-106020 dated Jul. 29, 2008.
English Language Translation of Final Office Action in Japanese Patent Application No. 2006-106020 dated Nov. 11, 2008.

* cited by examiner

*Primary Examiner*—David M Gray
*Assistant Examiner*—Barnabas T Fekete
(74) *Attorney, Agent, or Firm*—Buchanan Ingersoll & Rooney PC

(57) ABSTRACT

A charging member for electrically charging a substrate has a charge layer to be brought into contact with the substrate, an intermediate layer supporting the charge layer, and a support member supporting the intermediate layer. The intermediate layer has a first portion adjacent the charge layer and a second portion adjacent the support member, the first portion having a greater rigidity than that of the second portion.

15 Claims, 8 Drawing Sheets

CHARGING LAYER
FIRST LAYER
METAL CORE
CONVENTIONAL EXAMPLE 1
CONVENTIONAL EXAMPLE 2

FIRST LAYER
SECOND LAYER
METAL CORE
EXAMPLE FOR COMPARISON 1
EXAMPLE FOR COMPARISON 2
EXAMPLE FOR COMPARISON 3

CHARGING LAYER
FIRST LAYER
SECOND LAYER
METAL CORE
EXAMPLE OF INVENTION 1

*Fig.5*

| | | CONVENTIONAL EXAMPLE 1 | CONVENTIONAL EXAMPLE 2 | EXAMPLE FOR COMPARISON 1 | EXAMPLE FOR COMPARISON 2 | EXAMPLE FOR COMPARISON 3 | EXAMPLE OF INVENTION 1 |
|---|---|---|---|---|---|---|---|
| FIRST LAYER | RIGIDITY (kPa) | 100 | 500 | 100 | 100 | 500 | 500 |
| | LAYER THICKNESS (mm) | 3 | 3 | 1 | 1.25 | 0.75 | 1 |
| SECOND LAYER | RIGIDITY (kPa) | — | — | 500 | 1000 | 1000 | 100 |
| | LAYER THICKNESS (mm) | — | — | 2 | 1.75 | 2.25 | 2 |
| CHARGING LAYER | RIGIDITY (kPa) | 10000 | | | | | |
| | LAYER THICKNESS (mm) | 0.25 | | | | | |
| OUTER DIAMETER OF METAL CORE (mm) | | 5 | | | | | |
| OUTER DIAMETER OF CHARGING MEMBER (mm) | | 11.5 | | | | | |

CHARGING LAYER
FIRST LAYER
METAL CORE
CONVENTIONAL EXAMPLE 3

CHARGING LAYER
FIRST LAYER
SECOND LAYER
METAL CORE
EXAMPLE FOR COMPARISON 4
EXAMPLE FOR COMPARISON 5

CHARGING LAYER
FIRST LAYER
SECOND LAYER
METAL CORE
EXAMPLE OF INVENTION 2
EXAMPLE OF INVENTION 3

CHARGING LAYER
FIRST LAYER
SECOND LAYER
THIRD LAYER
METAL CORE
EXAMPLE OF INVENTION 4

Fig.9

| | | CONVENTIONAL EXAMPLE 3 | EXAMPLE FOR COMPARISON 4 | EXAMPLE FOR COMPARISON 5 | EXAMPLE OF INVENTION 2 | EXAMPLE OF INVENTION 3 | EXAMPLE OF INVENTION 4 |
|---|---|---|---|---|---|---|---|
| FIRST LAYER | RIGIDITY (kPa) | 100 | 100 | 500 | 1000 | 500 | 1000 |
| | LAYER THICKNESS (mm) | 3 | 2.25 | 1.75 | 1.75 | 1 | 1.25 |
| SECOND LAYER | RIGIDITY (kPa) | — | 1000 | 1000 | 500 | 100 | 500 |
| | LAYER THICKNESS (mm) | — | 0.75 | 1.25 | 1.25 | 2 | 0.75 |
| THIRD LAYER | RIGIDITY (kPa) | — | — | — | — | — | 100 |
| | LAYER THICKNESS (mm) | — | — | — | — | — | 1 |
| CHARGING LAYER | RIGIDITY (kPa) | 10000 | | | | | |
| | LAYER THICKNESS (mm) | 0.5 | | | | | |
| OUTER DIAMETER OF METAL CORE (mm) | | 5 | | | | | |
| OUTER DIAMETER OF CHARGING MEMBER (mm) | | 12 | 12 | 12 | 12 | 12 | 12 |

CHARGING MEMBER, CHARGER APPARATUS WITH CHARGING MEMBER, AND IMAGE FORMING APPARATUS HAVING CHARGER APPARATUS

RELATED APPLICATION

This application is based on patent application No. 2006-106020 filed in Japan, the entire content of which is hereby incorporated by references.

FIELD OF THE INVENTION

The present invention relates to a charging member for charging a substrate, a charger apparatus equipped with the charging member, and an image forming apparatus which includes the charger apparatus.

BACKGROUND OF THE INVENTION

Some image forming apparatuses include a contact charger which makes a charging member contact with a substrate such as an image bearing member to charge the image bearing member. In most contact chargers, an AC voltage is applied upon the charging member to charge the image bearing member, which allows the portions of the image bearing member to be charged more uniformly, compared with the case in which a DC voltage is applied upon the charge member.

Disadvantageously, the application of the AC voltage upon the charging member induces undesirable noise, or charge noise. The charge noise is a vibroacoustic signal of the charging member and/or the image bearing member, which is caused by an attractive force generated between the charging member and the image bearing member and periodically changing in synchronism with the frequency of the AC voltage.

JP 05-210281 A discloses an image forming apparatus capable of preventing or reducing the generation of the charge noise. The charging member of this apparatus includes a metal core or support member, an elastic layer supported on the metal core, and a charging layer disposed around the elastic layer for the contact with the image carrier. According to this apparatus, the generation of the charge noise is minimized by an appropriate design in thickness of the charging layer.

Practically, however, it is very difficult to provide the charging layer of the charging member with a function for reducing the generation of the charge noise. Specifically, the charging layer of the charging member needs to have characteristics of uniformly and stably charging the image bearing member, preventing a permanent compressive deformation due to the constant abutment with the image bearing member, and preventing a development of an electric leakage between the image carrier and the charging member. In addition to those indispensable features, it is very difficult in design and/or manufacture to provide the charging layer with another function of preventing the charge noise.

SUMMARY OF THE INVENTION

Accordingly, an object of the present invention is to provide a charging member capable of being manufactured easily and of preventing the generation of the charge noise, a charger apparatus equipped with the charging member, and an image forming apparatus which includes the charger apparatus.

To achieve the object above, a charging member according to the present invention has a charge layer to be brought into contact with a substrate to be charged, an intermediate layer supporting the charge layer, and a support member supporting the intermediate layer. The intermediate layer has a first portion adjacent the charge layer and a second portion adjacent the support member, the first portion having a greater rigidity than that of the second portion.

BRIEF DESCRIPTION OF THE DRAWINGS

FIG. 5 is a table showing structural characteristics of the charging members used in the First Experiment;

FIG. 9 is a table showing structural characteristics of the charging members used in the Second Experiment.

DETAILED DESCRIPTION OF THE PREFERRED EMBODIMENTS

Figure 1:
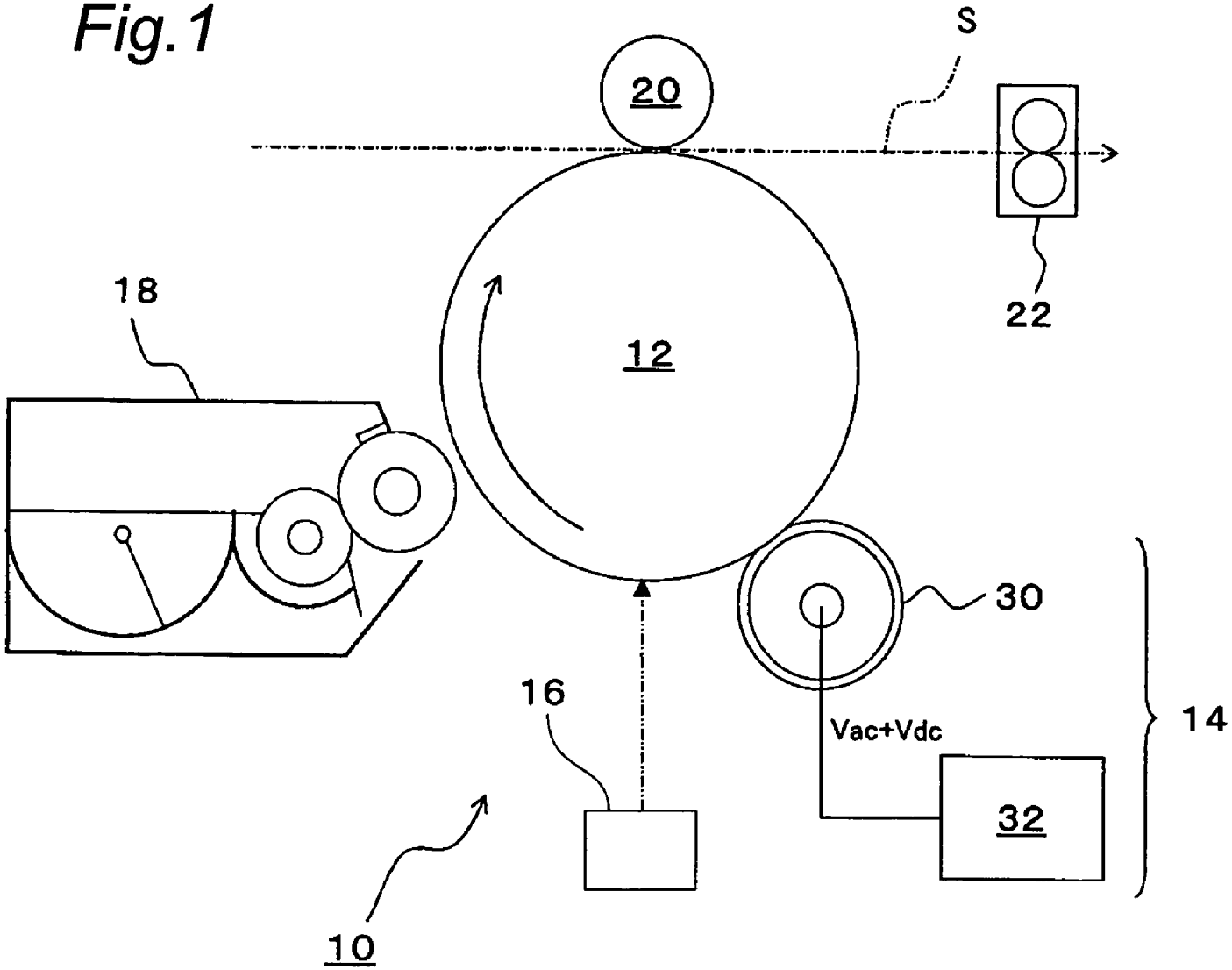
FIG. 1 is a schematic diagram showing a general structure of an image forming apparatus according to an embodiment of the present invention.

FIG. 1 schematically shows a structure of an image forming apparatus according to an embodiment of the present invention. The image forming apparatus generally indicated by reference numeral 10 generates a monochrome image on a sheet recording member (hereinafter referred to as "recording sheet") S.

The image forming apparatus 10 includes an image bearing member or photosensitive member 12, a charger 14 for electrically charging an outer circumferential surface of the photosensitive member 12, an exposure device 16 for forming an electrostatic latent image on the outer circumferential surface of the photosensitive member 12, a developer 18 for developing the electrostatic latent image on the outer circumferential surface of the photosensitive member 12, a transfer roller 20 for transferring the developed image onto the recording sheet S, and a fixing device 22 for fixing the developed image onto the recording sheet S.

The photosensitive member 12, which is in the form of cylinder, is so constructed as to bear the electrostatic latent image on its outer circumferential surface. The photosensitive member 12 is drivingly connected to a rotational drive means such as a motor to rotate at a constant rotational velocity. Alternatively, the photosensitive member may be an endless belt.

The charger 14, which is a device for charging the outer circumferential surface of the photosensitive member 12 by the contact therewith, includes a charging member 30 disposed in contact with the outer circumferential surface of the photosensitive member 12 and a power source for applying the charging member 30 with a superimposed voltage of AC and DC voltages. Details of the the charging member 30 will be described later.

The exposure device 16 is disposed at a certain position opposed against the outer circumferential surface of the photosensitive member 12, on the downstream side of the charger 14 with respect to the rotational direction of the photosensitive member 12, thereby defining an exposure region with the photosensitive member 12 between the exposure device 16 and the photosensitive member 12 where incremental portions of the charged outer circumferential surface of the photosensitive member 12 are exposed to light to form an electrostatic latent image as the photosensitive member 12 rotates.

The developer 18 is disposed at a certain position opposed against the outer circumferential surface of the photosensitive member 12, on the downstream side of the exposure region with respect to the rotational direction of the photosensitive member 12, thereby defining a development region with the photosensitive member 12 between the developer 18 and the photosensitive member 12. This allows the developer 18 to develop with toner the electrostatic latent image transported into the development region as the photosensitive member 12 rotates.

The transfer roller 20 is disposed at a certain position opposed against the outer circumferential surface of the photosensitive member 12 on the downstream side to the development region with respect to the rotational direction of the photosensitive member 12, thereby defining a transfer region with the photosensitive member 12 between the photosensitive member 12 and the transfer roller 20. This allows that, by means of contact pressure or heat, the developed image on the outer circumferential surface of the photosensitive member 12 is transferred onto the recording sheet S transported into the transfer region by a sheet transporting means (not shown). Instead of the transfer roller, a transfer charger, a transfer belt or the like may be used as the transfer means.

The fixing device 22 has a pair of opposed fixing rollers for fixing, by means of contact pressure or heat, the transferred developed image onto the recording sheet S in the region defined by the opposed fixing rollers.

According to the image forming apparatus so constructed, the outer circumferential surface of the photosensitive member 12 is charged uniformly by the charging member and then exposed to light from the exposure 16 to define the electrostatic latent image thereon. The electrostatic latent image is developed by the developer 18 into a visible image which is then transferred onto the recording sheet S.

Figure 2:
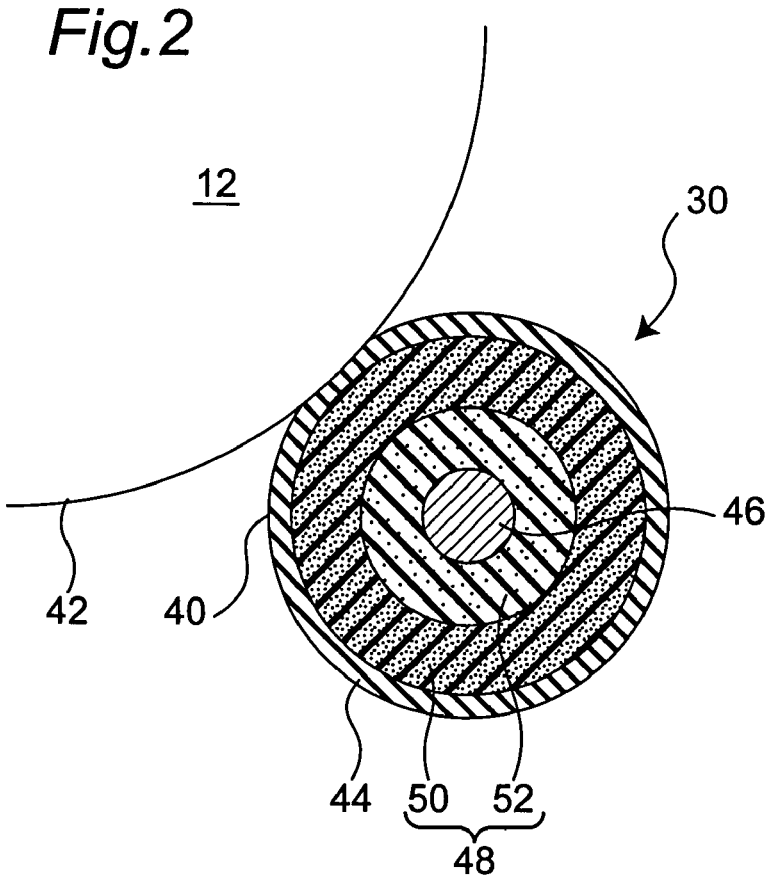
FIG. 2 is a cross sectional view of a charging member which contacts a photosensitive member.

The charging member 30 will now be described. FIG. 2 shows the cross section of the charging member 30 which is in contact with the outer circumferential surface of the photosensitive member 12. The charging member 30 in the form of cylinder has a rotational axis extending in parallel to the rotational axis of the photosensitive member 12, and is in contact at its outer circumferential surface 40 with the outer circumferential surface 42 of the photosensitive member 12. The charging member 30 includes an outermost charging layer 44 in contact with the outer circumferential surface 42 of the photosensitive member 12, an innermost metal core 46 or support member made of metal to which a certain voltage is applied, and an intermediate layer 48 which is disposed between the charging layer 44 and the metal core 46.

The charging layer 44, which makes a contact with the outer circumferential surface 42 of the photosensitive member 12 to charge the member up to a predetermined voltage, includes one or more sub-layers. The sub-layers of the charging layer may have, for instance, an electrically conductive layer which is made of substrate material made of such as urethane and electrically conductive powers or particles such as carbons dispersed in the substrate material, a protection layer made of such as nylon for reducing friction with the outer circumferential surface 42 of the photosensitive member 12 to prevent possible abrasion of the charging member 30, a resistance layer of rubber or the like which functions as electric resistance between the photosensitive member 12 and the metal core 46 for preventing an electric leakage between the photosensitive member 12 and the charging member 30. In order to charge the outer circumferential surface 42 of the photosensitive member 12 up to a predetermined electric potential, the charging layer 44 is capable of deforming so as to form a predetermined size of contact area on the outer circumferential surface 42 of the photosensitive member 12 and has a rigidity and/or thickness to the extent that, once the compressed charging layer 44 is released, it will recover to its original, uncompressed configuration without leaving any permanent deformation. Those arrangements ensure the desired charging, anti-deforming, and anti-leaking characteristics.

The metal core 46, which is supported by bearings (not shown) so that the outermost charge layer 44 contacts with the circumferential surface 42 of the photosensitive member 12, is electrically connected to a power source 32 for applying a superimposed voltage of AC and DC voltages, allowing the charging member 30 to charge the outer circumferential surface 42 of the photosensitive member 30 up to a certain voltage.

The intermediate layer 48 includes a first, outer sub-layer 50 adjacent the charging layer 44 and a second, inner sub-layer 52 adjacent the metal core 46. The first and second sub-layers may be made of the same material selected from among polystyrene, polyolefin, and polyester-based foamed member, and urethane.

The first and second sub-layers, 50 and 52, of the intermediate layer 48 are so designed that the first sub-layer 50 has a greater rigidity than that of the second sub-layer 52. The reason behind this will be understood from the later discussion. It should be understood that the rigidity is measured by the use of a conventional tensile testing machine.

The inventors developed a technique for preventing the charge noise caused by the application of the AC voltage to the charging member 30, wherein the function for preventing the charge noise is provided to the intermediate layer 48, rather than the charging layer 44. In addition, the method also provides the intermediate layer 48 not only with a first ability of deformation for creating a larger contact area between the charging member 30 and the photosensitive member 12 but also with a second ability of deformation for decreasing the vibration amplitudes of the charging member 30 and the photosensitive layer 12 caused by the application of AC voltage to thereby prevent the generation of the charge noise, although the second ability may be incompatible with the first ability.

Figure 3:
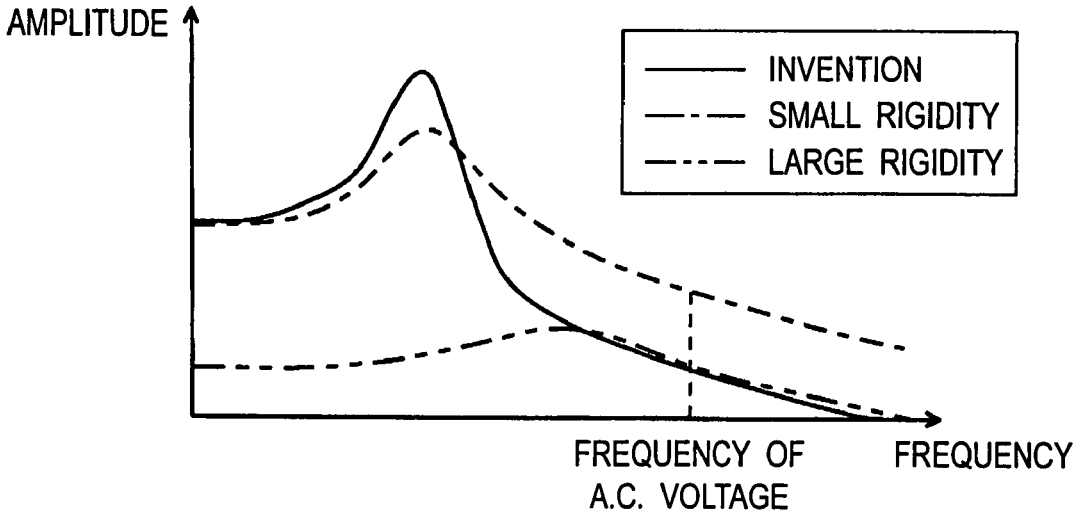
FIG. 3 is a graph which shows an idealistic vibration characteristic of the charging member according to the present invention.

Specifically, the technique includes the intermediate layer 48 with a decreased static rigidity and an increased dynamic rigidity, which will be described in terms of the vibration characteristics of charging members. FIG. 3 shows the vibration characteristics of charging members. In the drawing, the vibration characteristic of charging member in which the intermediate layer has a decreased rigidity is indicated by the dotted line and the vibration characteristic of a charging member in which the intermediate layer has an increased rigidity is indicated by the two-dotted line. The vibration characteristic of an ideal charging member according to the present invention with the decreased static rigidity and the increased dynamic rigidity is indicated by the solid line. As shown in the drawing, the ideal vibration characteristic is similar to that of the charging member with the intermediate layer having the increased rigidity in the range of higher frequency adjacent that of the AC voltage applied to the charging member and also is similar to the vibration characteristic of the charging member with the decreased rigidity in the range of lower frequency.

Inventors also discovered through two experiments using Computer Aided Engineering (CAE) analysis that it is advantageous for the first sub-layer 50 of the intermediate layer 48 to have a greater rigidity than the second sub-layer 52 in order to attain the charging member with the decreased static rigidity and the increased dynamic rigidity. Discussions will now be made to the details and the results of the experiments.

First Experiment

Figures 4A, 4B, 4C:
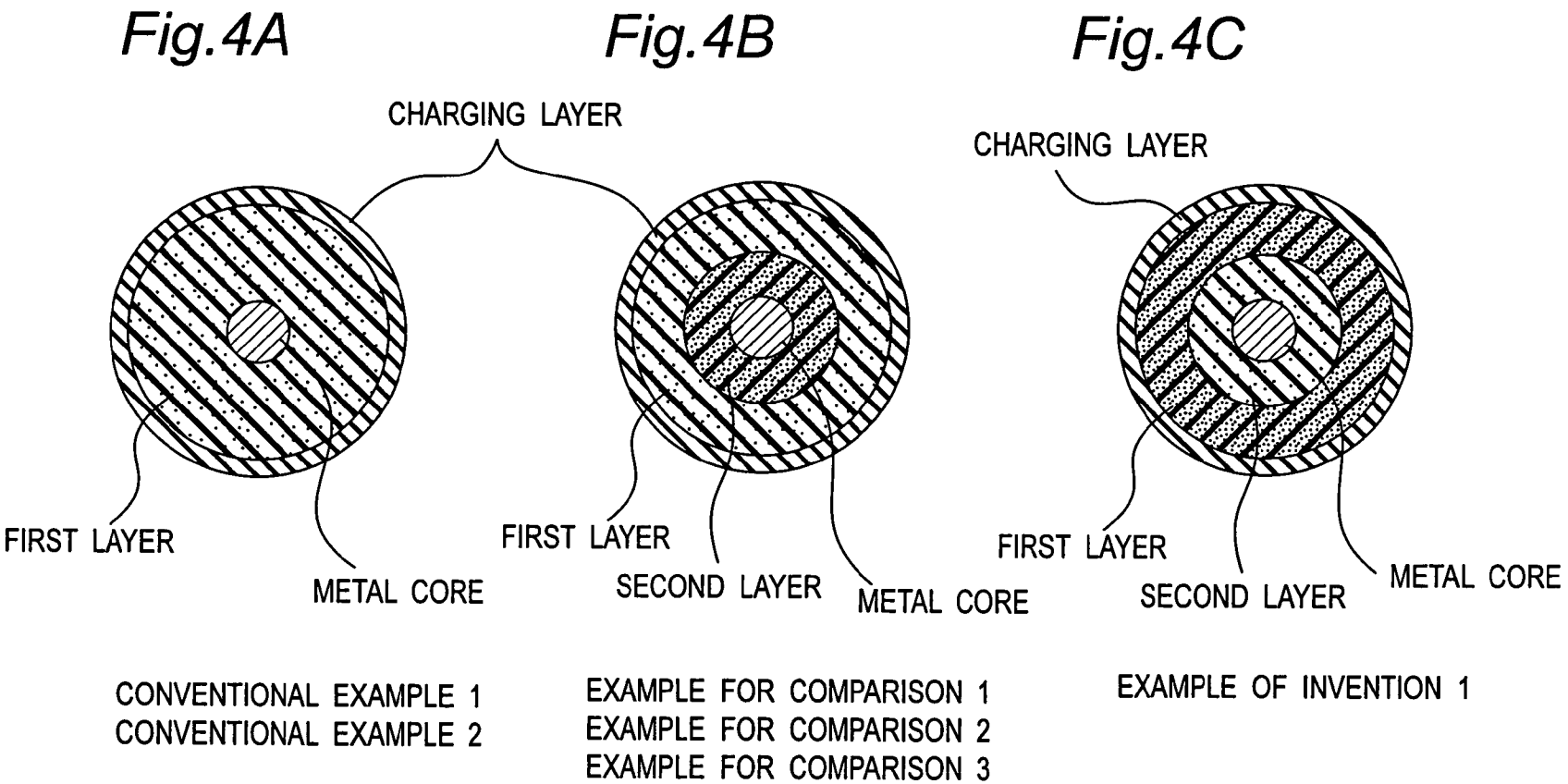
FIG. 4A is a cross sectional view of a conventional charging member used in the First Experiment.
FIG. 4B is a cross sectional view of a charging member of a comparative embodiment used in the First Experiment.
FIG. 4C is a cross sectional view of the charging member of the embodiment according to the present invention used in the First Experiment.

In this experiment, comparisons were made to the amplitude magnifications of three charging members; the conventional charging member in which the intermediate layer between the charging layer and the metal core is made of single layer (see FIG. 4A), a comparative charging member in which the intermediate layer is made of two, first and second sub-layers, the first sub-layer adjacent the charging layer having a smaller rigidity than the second sub-layer away from the charging layer (see FIG. 4B), and a charging member of the present invention in which the intermediate layer is made of two, first and second sub-layers, the first sub-layer adjacent the charging layer having a larger rigidity than the second sub-layer away from the charging layer (see FIG. 4C).

FIG. 5 shows the structural details of the three types of charging members used in the Experiments. As indicated in the table of the drawing, charging members between which the rigidity of the intermediate layer was different were used as the conventional charging members, as denoted at CONVENTIONAL EXAMPLE 1 and CONVENTIONAL EXAMPLE 2. Used as the charging members for comparison were charging members in which the rigidity of the first sub-layer was smaller than that of the second sub-layer and the rigidity, the layer thickness and the like of the first sub-layer were different from those of the second sub-layer, as denoted at EXAMPLE FOR COMPARISON 1, EXAMPLE FOR COMPARISON 2 and EXAMPLE FOR COMPARISON 3. The charging member described as EXAMPLE OF INVENTION 1 was used as the charging member according to the present invention in which the rigidity of the first sub-layer was greater than that of the second sub-layer.

The outer circumferential surfaces of the charging members were vibrated at a predetermined frequency, and the amplitude magnifications were calculated from the responsive amplitudes at the vibration amplitudes and the vibration points. The smaller the amplitude magnification of the charging member is, the smaller a charge noise is which is caused by application of AC voltage. In other words, the charging member exhibits an improved charge noise reduction. For better comparison, the amplitude magnifications of the respective charging members were calculated after normalizing the amplitudes so that the static rigidity would be the same, i.e., the amount of deformation of the charging member in contact with the outer circumferential surface of the photosensitive member would be the same.

Figure 6:
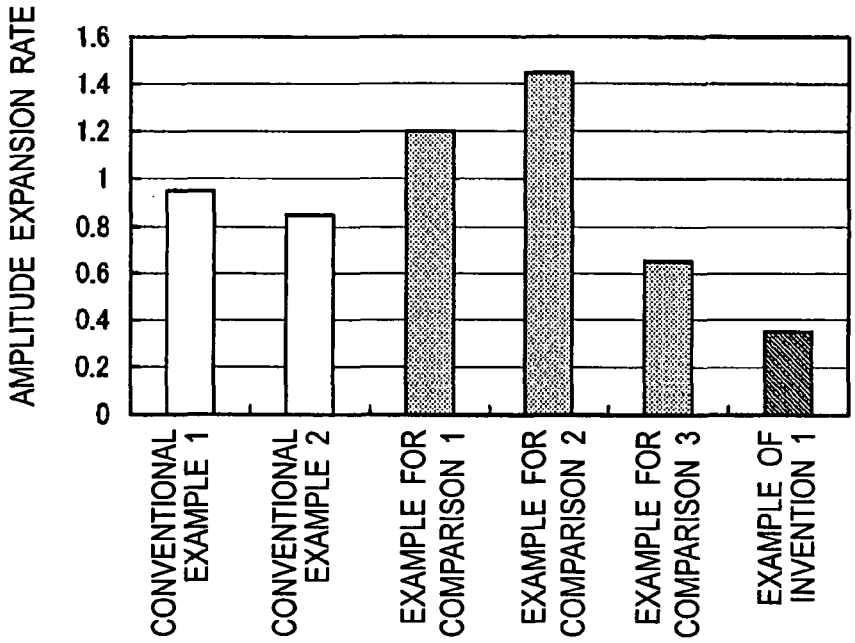
FIG. 6 is a graph showing a result of First the Experiment in terms of an amplitude of magnification.

FIG. 6 is a graph of the result of the experiments, showing the amplitude magnifications of the respective charging members. As shown in the drawing, the charging member according to the above-described embodiment in which the intermediate layer is formed by two sub-layers and the rigidity of the first sub-layer adjacent the charging layer is greater than that of the second sub-layer away from the charging layer, has the lowest amplitude magnification and exhibits the best charge noise reduction.

Figure 7:
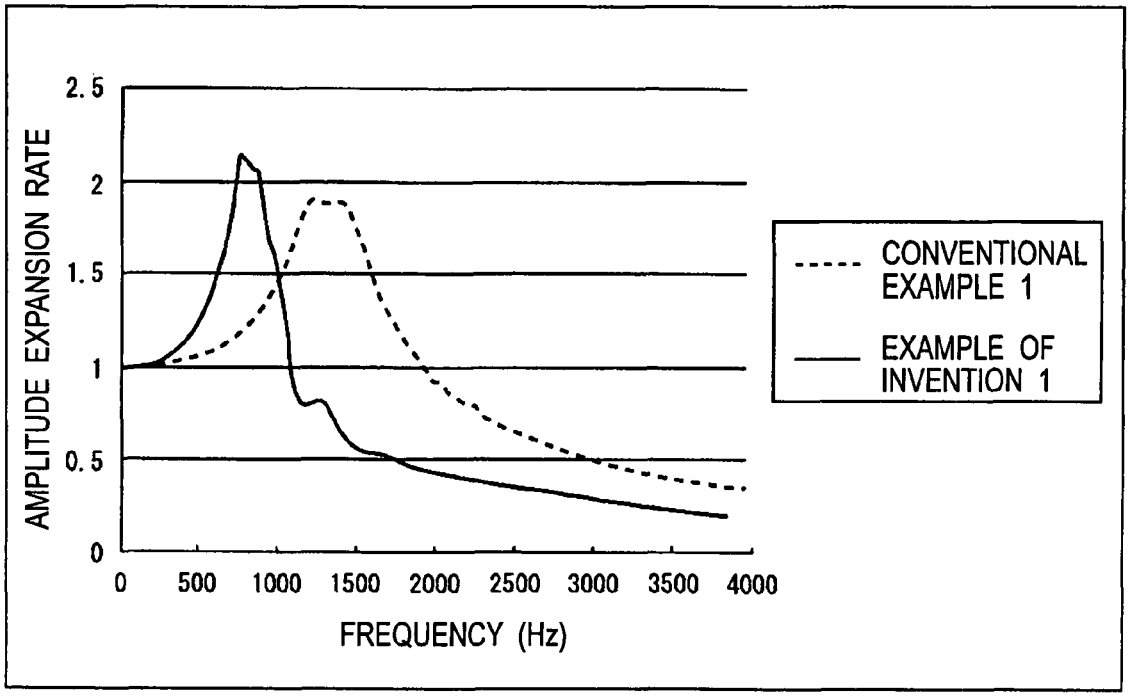
FIG. 7 is a graph showing a frequency versus magnification amplitude characteristics of the conventional charging member (Example 1) and the charging member of the present invention (Example 1)
Figures 8A, 8B, 8C, 8D:
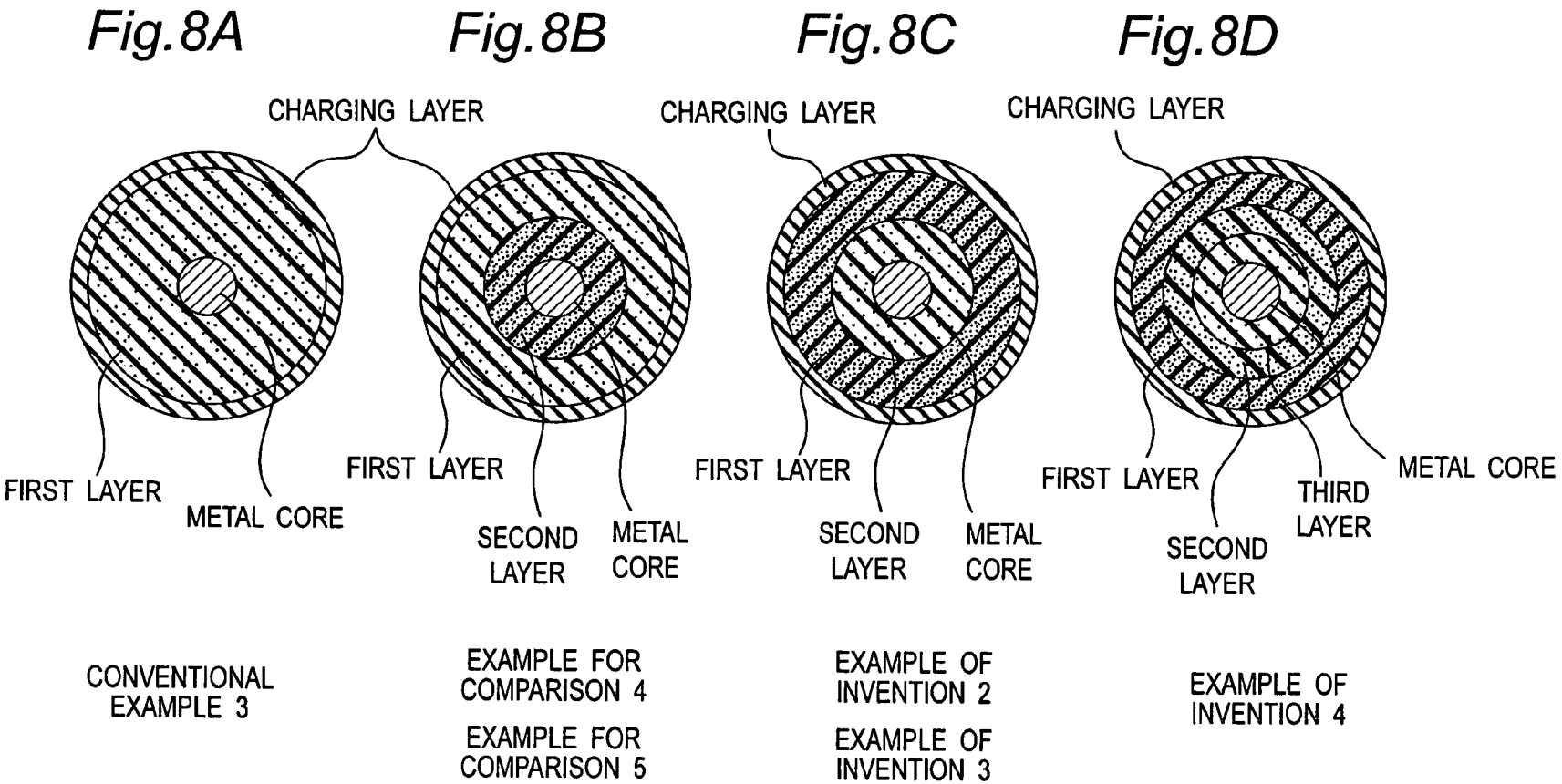
FIG. 8A is a cross sectional view of a conventional charging member (Conventional Example 3) used in the Second Experiment.
FIG. 8B is a cross sectional view of a conventional charging member (Comparative Examples 4, 5) used in the Second Experiment.
FIG. 8C is a cross sectional view of charging members (Examples 2, 3) used in the Second Experiment.
FIG. 8D is a cross sectional view of charging member (Examples 4) used in the Second Experiment.

FIG. 7 shows the vibration characteristics of the charging member according to CONVENTIONAL EXAMPLE 1 and the charging member according to EXAMPLE OF INVENTION 1. The vibration characteristics shown in the drawing were calculated after normalizing the amplitudes so that the static rigidity would be the same. As shown in the drawing, at the frequency of AC voltage which is generally applied upon a charging member or a higher frequency, namely, in a region of equal to or more than 1000 kHz (e.g., 2000 kHz), the amplitude of the charging member according to EXAMPLE OF INVENTION 1 is smaller than the amplitude of the charging member according to CONVENTIONAL EXAMPLE 1.

Further analyzing from a different view point, assuming that the intermediate layer of the charging member according to CONVENTIONAL EXAMPLE 1 is a single layer in which the density remains uniform from the metal core to the charging layer, the intermediate layer of the charging member according to EXAMPLE OF INVENTION 1, being of the same material across the first and the second sub-layers which form the intermediate layer, may be regarded as a single layer having a higher density at portions adjacent the charging member and a lower density at portions away from the charging member. It then follows that when the intermediate layer is to be formed by a single layer, the reduction of charge noise will be greater if the intermediate layer is formed as a single layer having a higher density at portions adjacent the charging member and a lower density at portions adjacent the metal core.

In Experiment 1, the charging members having structures indicated in FIG. 5 were fabricated using ethylene propylene rubber having the hardness of 8° according to the Japanese Industrial Standard-A (JIS-A) for the material of the first or the second sub-layer whose rigidity was 100 kPa, ethylene propylene rubber having the hardness of 30° according to the JIS-A for the material of the first or the second sub-layer whose rigidity was 500 kPa and ethylene propylene rubber having the hardness of 55° according to the JIS-A standard for the material of the second sub-layer whose rigidity was 1000 kPa. In addition, Experiment 1 was conducted using a test machine which pressed the charging members 0.5 mm and accordingly made the charging members contact on the photosensitive members having the diameter of 30 mm and rotate at the circumferential velocity of 120 mm/s following the driven photosensitive members.

Experiment 2

The same experiment as Experiment 1 was conducted, using charging members whose charging layers were thicker than those of the charging members used in Experiment 1. The charging members used were a conventional charging member in which an intermediate layer between the charging layer and the metal core was made of a single layer, charging members for comparison in each one of which an intermediate layer was formed by two sub-layers and the rigidity of a first sub-layer adjacent the charging layer was smaller than that of a second sub-layer away from the charging layer, charging members according to the present invention in each one of which an intermediate layer was formed by two sub-layers and the rigidity of a first sub-layer adjacent the charging layer was greater than that of a second sub-layer away from the charging layer, and a charging member according to the present invention in which an intermediate layer was formed by three sub-layers and the rigidity of each layer increased with a distance from a metal core toward the charging layer.

FIGS. 8A to 8D show the cross sectional views of the conventional charging member, the charging members for comparison and the charging members according to the present invention. FIG. 9 shows the structural details of the respective charging members.

The outer diameter of the metal core, the rigidity of the charging layer and the thickness of the charging layer are the same among the respective charging members. As the conventional charging member, a charging member whose intermediate layer had different rigidity was used as denoted at CONVENTIONAL EXAMPLE 3. Used as the charging members for comparison were charging members in which the rigidity of the first sub-layer adjacent the charging layer was smaller than that of the second sub-layer away from the charging layer and the rigidity, the layer thickness and the like of the first layer were different from those of the second sub-layer, as denoted at EXAMPLE FOR COMPARISON 4 and EXAMPLE FOR COMPARISON 5. The charging members described as EXAMPLE OF INVENTION 2 and EXAMPLE OF INVENTION 3 were used as the charging members according to the present invention in each one of which the intermediate layer was formed of two sub-layers and the rigidity of the first sub-layer adjacent the charging layer was greater than that of the second layer away from the charging layer. The charging member described as EXAMPLE OF INVENTION 4 was used as the charging member according to the present invention in which the intermediate layer was formed by three sub-layers and each of the sub-layer had a greater rigidity than that positioned closer to the metal core.

Figure 10:
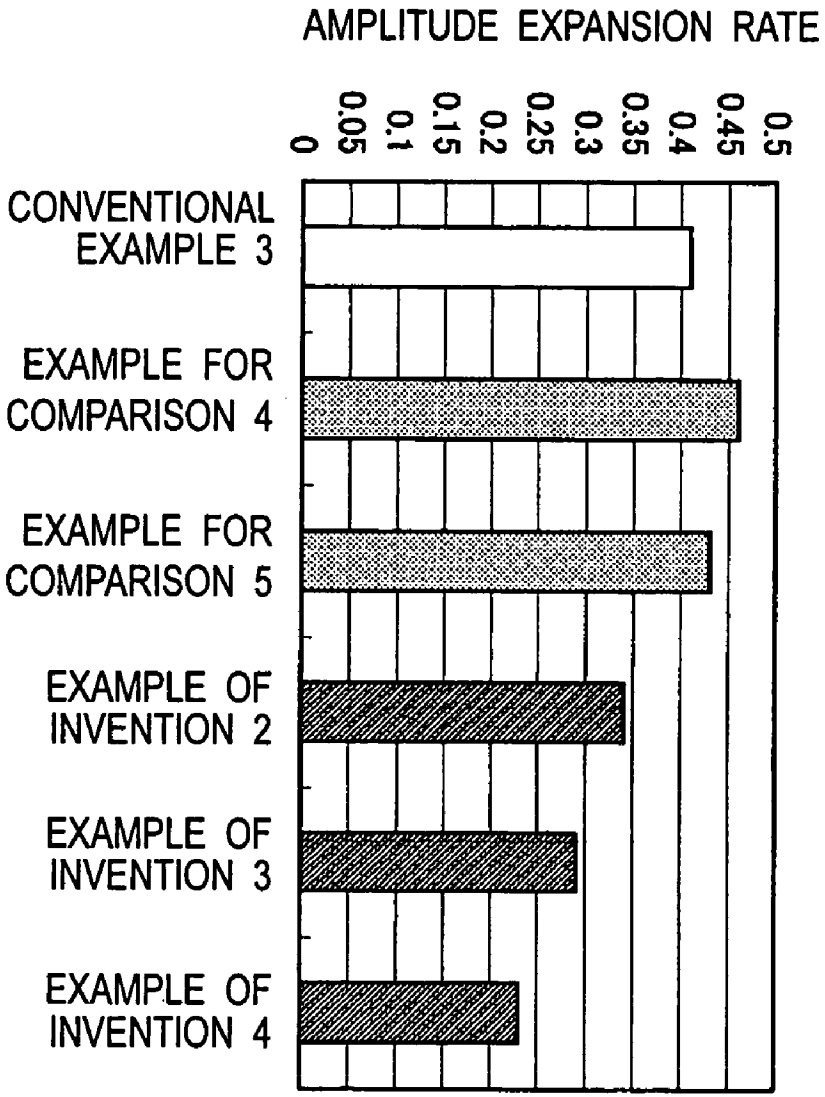
FIG. 10 is a graph showing a result of First the Experiment in terms of amplitude of magnification.

FIG. 10 is a graph of the result of the experiment. As shown in the drawing, irrespective of the structures of the intermediate layers, the amplitude magnifications of the respective charging members are lower than the rates found in Experiment 1. (See and compare the amplitude magnifications of the charging members according to CONVENTIONAL EXAMPLE 1 and CONVENTIONAL EXAMPLE 3 which are different only with respect to the thickness of the charging layer.) This means that the thickness of the charging member is attributable to the amplitude magnification. It is understood that the charging members according to EXAMPLE OF INVENTION 2 through EXAMPLE OF INVENTION 4 of the present invention have the lower amplitude magnifications than those of the other charging members.

It is also understood that among the charging members according to EXAMPLE OF INVENTION 2 through EXAMPLE OF INVENTION 4 of the present invention, the charging member according to EXAMPLE OF INVENTION 4 in which the intermediate layer is formed by three sub-layers and each of the sub-layer has a greater rigidity than that positioned closer to the metal core exhibits the lower amplitude magnification than those of the charging members according to EXAMPLE OF INVENTION 2 and EXAMPLE OF INVENTION 3 in which the intermediate layer is formed by two sub-layers and the rigidity of the first sub-layer adjacent the charging layer exceeds that of the second sub-layer away from the charging layer. This means that the amplitude magnification becomes smaller, i.e., the effect of reducing a charge noise becomes greater when the rigidity of the intermediate layer increases stepwise with a distance from the metal core toward the charging layer.

In Experiment 2, the charging members having structures indicated in FIG. 9 were fabricated using ethylene propylene rubber having the hardness of 8° according to the JIS-A standard as the material of the first, the second or the third sub-layer whose rigidity was 100 kPa, ethylene propylene rubber having the hardness of 30° according to the JIS-A standard as the material of the first or the second layer whose rigidity was 500 kPa and ethylene propylene rubber having the hardness of 55° according to the JIS-A as the material of the first or the second sub-layer whose rigidity was 1000 kPa. Experiment 2 as well was conducted similarly to Experiment 1, using a test machine which pressed the charging members by the pressing force of 0.5 mm and accordingly made the charging members contact on the photosensitive members having the diameter of 30 mm and rotate at the circumferential velocity of 120 mm/s following the driven photosensitive members.

From the test results of the two experiments described above, it is understood that a charging member exhibits an improved charge noise reduction regardless of the thickness of a charging layer when an intermediate layer between the charging layer and the metal core is formed so that its rigidity near the charging layer is greater than that near the metal core. It is further understood that the charging member exhibits an even better charge noise reduction when the rigidity of the intermediate layer increases stepwise with a distance from the metal core toward the charging layer.

According the embodiment described above, instead of forming the charging layer 44 on the outer circumferential surface 42 of the photosensitive member 12 such that the charging layer 44 will have a function of reducing the charge noise, the intermediate layer 48 between the charging layer 44 and the metal core 46 is formed so that its rigidity increases with a distance from the metal core 46 toward the charging layer 44, and therefore, the intermediate layer 48 is equipped with the function of reducing the charge noise. Also, the intermediate layer 48 has the function of reducing the charge noise while the charging layer 44 maintains the charging, anti-deforming, and anti-leaking functions, which makes it easier to design and manufacture the charging member 30 as compared with where the charging layer 44 is supposed to have all four functions.

While the foregoing has described the invention in relation to one embodiment thereof, the present invention is not limited to this embodiment.

Although the embodiment above is directed to an image forming apparatus which forms a monochrome image, the present invention is applicable of course to an image forming apparatus of the tandem type which uses a photosensitive member for each color and is capable of forming a full-color image. Since an image forming apparatus of the tandem type has as many charging members and photosensitive members as colors to use, that is, since it includes many sources of a charge noise, the effect of suppressing a charge noise according to the present invention is more beneficial than for an image forming apparatus which forms a monochrome image.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. A charging member which contacts and charges a substrate, comprising:

a charge layer to be brought into contact with the substrate;

an intermediate layer supporting the charge layer; and a support member supporting the intermediate layer, wherein the intermediate layer has a first portion adjacent the charge layer, a second portion adjacent the support member, and a third portion between the first portion and the second portion, a rigidity of each of the first, second and third portions increasing with distance from the support member to the charge layer, and the first portion having a radial thickness of 1 mm or more.

2. The charging member of claim 1, wherein the first portion of the intermediate layer includes a first sub-layer and the second portion of the intermediate layer includes a second sub-layer, the first sub-layer having the greater rigidity than that of the second sub-layer.

3. The charging member of claim 2, wherein the first sub-layer and the second sub-layer are made of substantially the same material and the first sub-layer has a greater density than that of the second sub-layer.

4. The charging member of claim 1, wherein the second portion has a radial thickness of 0.75 mm or more.

5. The charging member of claim 1, wherein the charge layer includes at least two sub-layers.

6. A charger apparatus for charging a substrate, comprising:

a charging member having a charge layer to be brought into contact with the substrate, an intermediate layer supporting the charge layer, and a support member supporting the intermediate layer, the intermediate layer having a first portion adjacent the charge layer, a second portion adjacent the support member, and a third portion between the first portion and the second portion, a rigidity of each of the first, second and third portions increasing with distance from the support member to the charge layer, and the first portion having a radial thickness of 1 mm or more; and a power supply which supplies a voltage to the charging member.

7. The charger apparatus of claim 6, wherein the first portion of the intermediate layer includes a first sub-layer and the second portion of the intermediate layer includes a second sub-layer, the first sub-layer having the greater rigidity than that of the second sub-layer.

8. The charger apparatus of claim 7, wherein the first sub-layer and the second sub-layer are made of substantially the same material and the first sub-layer has a greater density than that of the second sub-layer.

9. The charger apparatus of claim 6, wherein the second portion has a radial thickness of 0.75 mm or more.

10. The charger apparatus of claim 6, wherein the charge layer includes at least two sub-layers.

11. An image forming apparatus; comprising:

an image bearing member having an image bearing surface;

a charger device having a charging member and a power source for applying a voltage to the charging member for electrically charging the image bearing surface of the image bearing member, the charging member having a charge layer to be brought into contact with the image bearing member, an intermediate layer supporting the charge layer, and a support member supporting the intermediate layer, the intermediate layer having a first portion adjacent the charge layer, a second portion adjacent the support member, and a third portion between the first portion and the second portion, a rigidity of each of the first, second and third portions increasing with distance from the support member to the charge layer, and the first portion having a radial thickness of 1 mm or more;

an electrostatic latent image forming device which forms an electrostatic latent image on the electrically charged image bearing surface of the image bearing member; and a developer which supplies toner particles to the electrostatic latent image to visualize the electrostatic latent image into a visual toner image.

12. The charger apparatus of claim 11, wherein the first portion of the intermediate layer includes a first sub-layer and the second portion of the intermediate layer includes a second sub-layer, the first sub-layer having the greater rigidity than that of the second sub-layer.

13. The charger apparatus of claim 12, wherein the first sub-layer and the second sub-layer are made of substantially the same material and the first sub-layer has a greater density than that of the second sub-layer.

14. The charger apparatus of claim 11, wherein the second portion has a radial thickness of 0.75 mm or more.

15. The charger apparatus of claim 11, wherein the charge layer includes at least two sub-layers.

* * * * *